US005799432A

United States Patent [19]

Wright, Sr. et al.

[11] Patent Number: 5,799,432

[45] Date of Patent: Sep. 1, 1998

[54] SELF-CONTAINED MAGAZINE AND WEAPON SYSTEM INCORPORATING SAME

[75] Inventors: Barry M. Wright, Sr., Box 202, W. River Rd. N., Fulton, N.Y. 13069; Barry M. Wright, Jr., 995 66th Rd., Hannibal, N.Y. 13074; Mitchell S. Burko, Syracuse, N.Y.

[73] Assignees: Barry M. Wright, Sr.; Barry M. Wright, Jr., both of N.Y.

[21] Appl. No.: 798,806

[22] Filed: Feb. 12, 1997

[51] Int. Cl.[6] ..... F41A 9/62

[52] U.S. Cl. ..... 42/1.02

[58] Field of Search ..... 42/1.01–1.03, 42/84, 70.01, 70.11, 50

[56] References Cited

U.S. PATENT DOCUMENTS

| | | | |
|---|---|---|---|
| 545,708 | 9/1895 | Mason . | |
| 1,251,910 | 1/1918 | Murphy . | |
| 1,653,698 | 12/1927 | Coupland . | |
| 1,892,141 | 12/1932 | Garand . | |
| 2,303,479 | 12/1942 | Lesnick | 89/33 |
| 2,306,747 | 12/1942 | Ojalvo | 42/1 |
| 2,377,661 | 6/1945 | Baker et al. | 42/50 |
| 2,569,995 | 10/1951 | Kapsa | 124/52 |
| 2,828,568 | 4/1958 | Sakewitz | 42/50 |
| 3,024,453 | 3/1962 | Ransom | 340/280 |
| 4,001,961 | 1/1977 | Johnson et al. | 42/1 |
| 4,541,191 | 9/1985 | Morris et al. | 42/1 |
| 4,587,756 | 5/1986 | Jakubaschk et al. | 42/50 |
| 5,005,307 | 4/1991 | Horne et al. | 42/1.02 |
| 5,052,138 | 10/1991 | Crain | 42/1.02 |
| 5,142,805 | 9/1992 | Horne et al. | 42/1.02 |
| 5,206,444 | 4/1993 | Oliver | 42/1.02 |
| 5,303,495 | 4/1994 | Harthcock | 42/84 |
| 5,318,522 | 6/1994 | D'Antonio | 604/72 |
| 5,406,730 | 4/1995 | Sayre | 42/1.02 |
| 5,425,299 | 6/1995 | Teetzel | 90/14.4 |
| 5,519,953 | 5/1996 | Villani | 42/1.02 |
| 5,569,190 | 10/1996 | D'Antonio | 604/72 |
| 5,642,581 | 7/1997 | Herold et al. | 42/1.02 |

FOREIGN PATENT DOCUMENTS

| | | |
|---|---|---|
| 0 549 288 A2 | 6/1993 | European Pat. Off. . |
| 463244 | 12/1912 | France . |
| 409519 | 2/1945 | Italy . |
| 272088 | 4/1969 | U.S.S.R. . |
| 2 182 424 | 9/1985 | United Kingdom . |

*Primary Examiner*—Charles T. Jordan
*Assistant Examiner*—Matthew J. Lattig
*Attorney, Agent, or Firm*—Parkhurst & Wendel

[57] ABSTRACT

A self-contained magazine for a firearm includes a housing for receiving a plurality of rounds therein, the housing including an open end through which rounds are loaded and unloaded, a follower provided in the housing, said follower being slidable along a longitudinal axial direction of the magazine, a spring biasing the follower toward the open end, to bias rounds toward the open end, an electronic counter means integrated in the magazine for calculating the number of rounds contained in the magazine upon loading rounds into and unloading rounds from the magazine, and display means for displaying the number of rounds in the magazine. The present invention provides a self-contained magazine for a firearm that incorporates all essential features for calculating and displaying the number of rounds therein as the number changes due to loading and unloading. The magazine is accurate, reliable under all weather conditions, and can retroactively fit with any firearm that utilizes a magazine, so that existing firearms can continue to be utilized while taking advantage of the advanced functions provided by the present invention. The present invention provides vital information to the user to maximize the user's ability to protect, survive and prevail. The present invention is also drawn to a weapon system including a firearm and self-contained magazine.

18 Claims, 5 Drawing Sheets

SELF-CONTAINED MAGAZINE AND WEAPON SYSTEM INCORPORATING SAME

BACKGROUND OF THE INVENTION

The invention generally relates to an ammunition supply indicating system, particularly, an integrated, self-contained magazine for a firearm that can reliably and accurately communicate the number of rounds contained in the magazine, and a weapon system including the magazine and a firearm.

Knowing the number of rounds remaining for discharge in a firearm has become increasingly difficult with modern high capacity firearms. Having absolute, certain knowledge of the number of rounds available to the user has become increasingly critical to safeguard the survival of law enforcement officers, security/protection service agents and military personnel. This knowledge lets an officer use his rounds efficiently and effectively thus increasing one's chances to be in a good position for reload, and thereby increasing one's chances for survival. While ammunition supply systems including means for displaying remaining rounds in the firearm have been developed in the art, prior systems have suffered from numerous disadvantages.

Generally, prior art systems require a particular firearm in which the particular components for (i) sensing firearm discharge, (ii) calculating the number of remaining rounds, and (iii) displaying the number of remaining rounds, are integrated with the firearm itself. Such systems, even if integrated with a quality firearm, tend to interfere with the overall balance, operation (i.e., holstering and unholstering), and aesthetics of the firearm, and reduce reliability because of increased complexity of the firearm. Reduced reliability increases the possibility of firearm malfunction. Moreover, such systems are not cost effective, requiring the user to forego a conventional model with an updated model having the above-noted components. Or, extensive retrofitting is required which is costly and not of the quality associated with mass production.

U.S. Pat. Nos. 5,406,730, 5,142,805 and 5,052,138 are a few examples of firearms that incorporate an indicating means for displaying the number of rounds remaining in the firearm. According to U.S. Pat. No. 5,406,730, a sound pressure switch, such as a piezoelectric device, is utilized to detect firing of the firearm. Before the firearm is first fired, the user is required to input data to indicate the number of rounds loaded into the firearm. Such input may not be feasible during high-stress situations, such as those encountered with increasing frequency by law enforcement personnel, for example.

U.S. Pat. No. 5,142,805 discloses a weapon system similar to that of the '730 patent. Rather than utilizing a sound pressure switch, the '805 patent discloses a firearm that relies upon action of a slide mechanism to calculate the number of rounds remaining after firing. The firearm of the '805 patent also suffers from the disadvantages discussed above with respect to the '730 patent.

U.S. Pat. No. 5,052,138 discloses a weapon system in which a counter means is provided within a magazine, which is adapted to be loaded within the magazine well of a firearm. The initial number of rounds loaded into the firearm is transmitted from the magazine to the firearm, and upon movement of the slide of the firearm, rounds are subtracted. The number of rounds remaining are then displayed on a display device mounted along a side of the firearm. The '138 patent discloses a plurality of switches that are provided along an axial direction inside the magazine. As the magazine follower (which supports the rounds) translates through the magazine, succeeding switches are tripped (bridged), and tripping of the switches is correlated to the number of rounds loaded within the magazine. This initial count is then decreased as the firearm is fired, due to action of the slide of the firearm upon firing.

Although the magazine itself calculates the number of rounds initially loaded into the firearm, the system requires integration with the firearm, particularly, sensing components associated with the slide of the firearm to subtract rounds from the initial count provided by the magazine. The magazine is not self-contained, and must be utilized with a particular firearm. Moreover, the switch means provided along the interior of the magazine is largely inaccurate and unreliable. Particularly, the magazine cannot differentiate between upward and downward movement of the follower and cannot calculate the relative position of the follower. That is, the magazine itself cannot count down the number of rounds during unloading, either by unloading manually or by firing the firearm. Accordingly, in a situation wherein rounds are loaded in the magazine and then removed manually before inserting the magazine into the firearm, an inaccurate count is recorded by the magazine, and this inaccurate count is then relayed to the firearm. In this case, the user cannot absolutely rely upon the number of rounds displayed by the firearm, and may unknowingly place oneself in a particularly dangerous situation.

Other conventional ammunition supply indicating systems also utilize relatively simple mechanical gauges, such gauges generally being visible through the handle or stock of the firearm. In particular, indicia may be visible through a window in a hand grip of a firearm and the follower may be visible therethrough, allowing the user to physically view the number of rounds remaining, as indicated by the position of follower with respect to the indicia. However, such mechanical systems generally require modification of the firearm, which is not particularly desirable. Further, the indicia are generally provided along the side portion of the hand grip of the firearm which does not allow easy viewing of the remaining rounds during repeated firing, particularly in high-stress situations. Furthermore, such mechanical systems do not incorporate advanced features that can be provided by modern electronic systems, that essentially increase the amount of information conveyed to the user, to maximize safety, effectiveness, etc. of the ammunition supply indicating system and operation of the firearm. Examples of such prior art systems can be reviewed in U.S. Pat. Nos. 5,519,953, 5,206,444 and 2,828,568, by way of example.

SUMMARY OF THE INVENTION

It is an object of the present invention to provide a self-contained magazine for a firearm that incorporates all essential features for calculating and displaying the number of rounds therein as the number changes due to loading and unloading. The magazine overcomes the disadvantages of the prior art and is accurate, reliable under all weather conditions, and can retroactively fit with any firearm that utilizes a magazine, so that existing firearms can continue to be utilized while taking advantage of the advanced functions provided by the present invention.

The present invention has been developed to provide a cost-effective alternative to known ammunition supply indicating systems. In addition, the present invention has been developed to provide a relatively flexible and user friendly indicating system. The present invention provides vital information to the user to maximize the user's ability to protect, survive and prevail. The present invention also permits the user to reload the firearm with a fresh magazine before depleting the current magazine.

To meet these objectives, the present invention provides a magazine for a firearm, the magazine being fully integrated with an ammunition supply indicating system and including a housing for receiving a plurality of rounds therein, the housing including an open end through which rounds are loaded and unloaded, a follower provided in the housing, the follower being slidable along a longitudinal axial direction of the magazine, a spring biasing the follower toward the open end, to bias rounds toward the open end, an electronic counter means integrated in the magazine for calculating the number of rounds contained in the magazine upon loading and unloading the magazine, and a display means for displaying the number of rounds in the magazine.

The electronic counter means preferably includes a position sensor for generating a signal that is a function of a linear position of the follower within the magazine, a computing circuit for receiving the signal from the position sensor and correlating that signal to the number of rounds in the magazine, and a power source for supplying power to the position sensor and computing circuit. In this particular embodiment, the computing circuit is connected to the display means for displaying the number of rounds. The computing circuit may be embodied as a programmable logic circuit, a custom integrated circuit, or a microcontroller.

Two particular forms of the position sensor have been developed, and are discussed in more detail hereinbelow. Particularly, a cable take-up system has been developed wherein a cable is connected to the follower and wound around a drum that is connected to a rotary encoder device. The rotary encoder device generates a signal that is sent to the computing circuit for correlating the angular position of the drum to the position of the follower and hence to the number of rounds.

A preferred embodiment of the position sensor has been developed that utilizes rangefinding technology. The rangefinder utilizes a light source, laser or incoherent, that can generate infra-red or visible light, for example. The rangefinder includes an emitting means that projects a light beam against the follower and illuminates a point on the follower. The point of illumination is the object spot. The object spot is focussed into an image spot on the position sensitive detector by a lens. Movement of the follower causes displacement of the object spot and displacement of the image spot. The particular position of the image spot on the position sensitive detector may be correlated to absolute or relative position of the follower by utilizing a triangulation technique, particularly employing infra-red or visible laser light sources, as well as incoherent light sources.

Preferably, the display means integrated with the weapon system is provided along a bottom portion of the magazine and is positioned to face the user during firing conditions, and which is fully visible during firing. The display means may particularly be formed by an LCD, an LED, a vacuum fluorescent display, or an electroluminescent display, that displays the number of rounds contained in the magazine. In addition to displaying the number of rounds, the display may also provide other useful information to the user, such as the particular type of round utilized (e.g., hollow point, solid point, armor piercing etc.), or grain weight of the rounds loaded in a magazine. This information may be inputted by the user utilizing appropriate input means, similar to the manner in which data is inputted into an LCD watch, such as a switch connected to the computing circuit. Preferably, the display is backlit by a light source, such as by an LED, or an incandescent, luminous or electroluminescent light source. These features permit the user to load several magazines with different types of rounds and permit the user to switch magazines of different rounds at any time, depending upon the particular needs of the user.

Preferably, the magazine includes an on-off switch that is automatically depressed by loading the magazine in the magazine well of the firearm. The on-off switch connects power to the components of the magazine. The on-off switch may also be manually depressed by the user before insertion into the firearm to check the number of rounds therein, as well as additional information, such as grain weight, round type, etc. The on-off switch may also be non-mechanical, such as two contact strips that are bridged by an already existing conductive component within the magazine well of the firearm.

More often than not, the user will insert a loaded magazine into firearm that already contains a round in the chamber thereof. In view of this distinct possibility, preferably the magazine according to the present invention warns the user that there is a distinct possibility of a round already provided in the chamber. For example, a seventeen round capacity magazine loaded with seventeen rounds may be inserted into the magazine well of the firearm that already contains a chambered round therein. Upon sensing (such as by an appropriate sensor) the round contained in the chamber, the display preferably indicates to the user that a round may be present in the chamber. For example, the display may oscillate, at a conspicuous frequency, between the number of rounds in the magazine and the number of rounds contained in the firearm. That is, the number may oscillate between seventeen and eighteen rounds. In such a case, preferably seventeen and eighteen are respectively displayed once per second over a duration of five seconds, whereupon the display will return to the present number of rounds loaded in the magazine, seventeen, and count-down the number of rounds in the magazine without regard to the round in the chamber. This particular function is intended to warn the user about the possibility of the presence of a round in the chamber after inserting a loaded magazine.

According to a particular development of the invention, the magazine can distinguish between an in-gun state and an out-of-gun state. In particular, there are three conditions in which the magazine may be deployed, out-of-gun, in-gun with breech open, and in-gun with breech closed. The first two conditions provide substantially the same follower position for a given number of rounds. However, in the in-gun condition while the breech is closed, the rounds are displaced in the magazine, that is, are forced further into the magazine. An appropriate switching device may be provided along a top portion of the magazine to distinguish between the in-gun position with breech closed and the other two positions. In such a case, the computing circuit is encoded with appropriate information that is accessed from the computing circuit by a signal from the switching device, in the in-gun closed breech position, such that an accurate count is always displayed.

It is particularly important to appreciate that according to the present invention, when a round is unloaded, either manually or by firing the firearm, the count is always adjusted. This particular function is made possible by use of the position sensor that can determine absolute position of the follower at any time the magazine is in the "on" position. In contrast, the magazine of U.S. Pat. No. 5,052,138

(discussed above) cannot accurately determine the number of rounds remaining in the magazine as rounds are manually unloaded. An accurate count is provided only when the magazine is unloaded by firing.

The magazine of the present invention advantageously indicates to the user a low load condition, such as when the number of rounds contained in the magazine drops to five or lower. The display may flash at a conspicuous frequency as the rounds are depleted to the low load condition. The back-lighting color, sound (for competitive shooting), or vibration may also be used to indicate a low load condition. When all rounds are depleted from the magazine, the display may show "CC" for check chamber.

The computing circuit may also record the date and time of a round removed from the magazine, the orientation of the magazine (in-gun vs. out-of gun, pitch, roll, yaw, compass heading) upon round removal, and date and time of magazine insertion into the firearm magazine well, this information may assist in re-creation of firing sequences and crime scenes at a later date. The recorded information may be downloaded at a later time. These particular functions may prove useful for law enforcement and private security applications.

Furthermore, preferably the magazine includes a secondary power source to improve reliability. As the first, primary power source becomes low, an indication may be made by the display means to the user that it has switched to the secondary power source. This function will enable the user to have an opportunity to replace the primary power source.

Still further, the cable is preferably coated with Teflon® or the like to ensure smooth operation over an extended period of use, and the spring is sealed, preferably hermetically sealed, by a protective wrap such as TYVEK® or the like.

BRIEF DESCRIPTION OF THE DRAWINGS

The invention will be better understood and its numerous objects and advantages will become more apparent to those skilled in the art by reference to the following drawings, in conjunction with the accompanying specification in which.

Figure 1B:
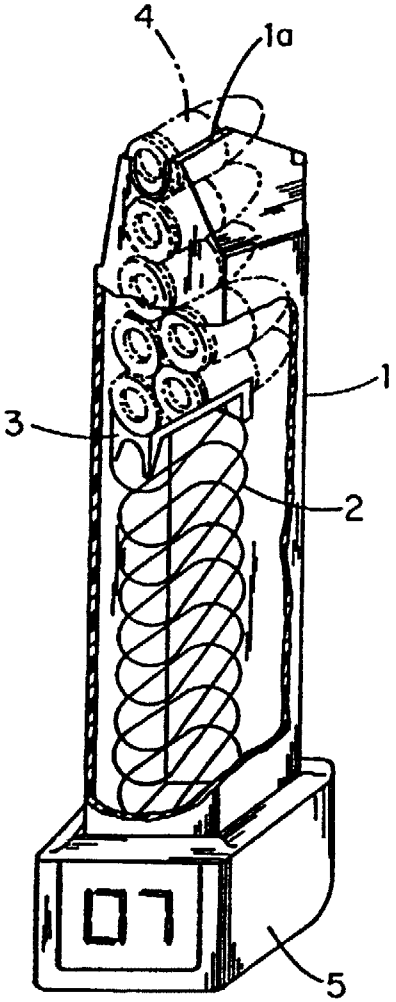
FIG. 1*b* is a cut-away elevated rear perspective view of the self contained magazine removed from the magazine well of the firearm.

The following elements are used in the drawings:

| | |
|---|---|
| housing 1 | battery 110 |
| retention flanges 1a | inner housing 111 |
| spring 2 | home switch 120 |
| follower 3 | breakaway clip 130 |
| rounds 4 | fingers 130a |
| housing extension 5 | protrusion 130b |
| upper wall 5a | orifice 131 |
| firearm 10 | seal 132 |
| cable 101 | infra-red (IR) emitter 201 |
| drum 102 | focussing lens 203 |
| clock spring 103 | position sensitive detector 204 |
| shaft 104 | signal processor 205 |
| rotary encoder 105 | computing ciruit 206 |
| fixed part 105a | display 207 |
| rotating part 105b | back-light source 208 |
| display 106 | battery 209 |
| back-light source 107 | on-off switch 210 |
| on-off switch 108 | collimating lens 212 |
| computing circuit 109 | home switch 220 |

DETAILED DESCRIPTION OF THE PREFERRED EMBODIMENTS

Figure 1A:
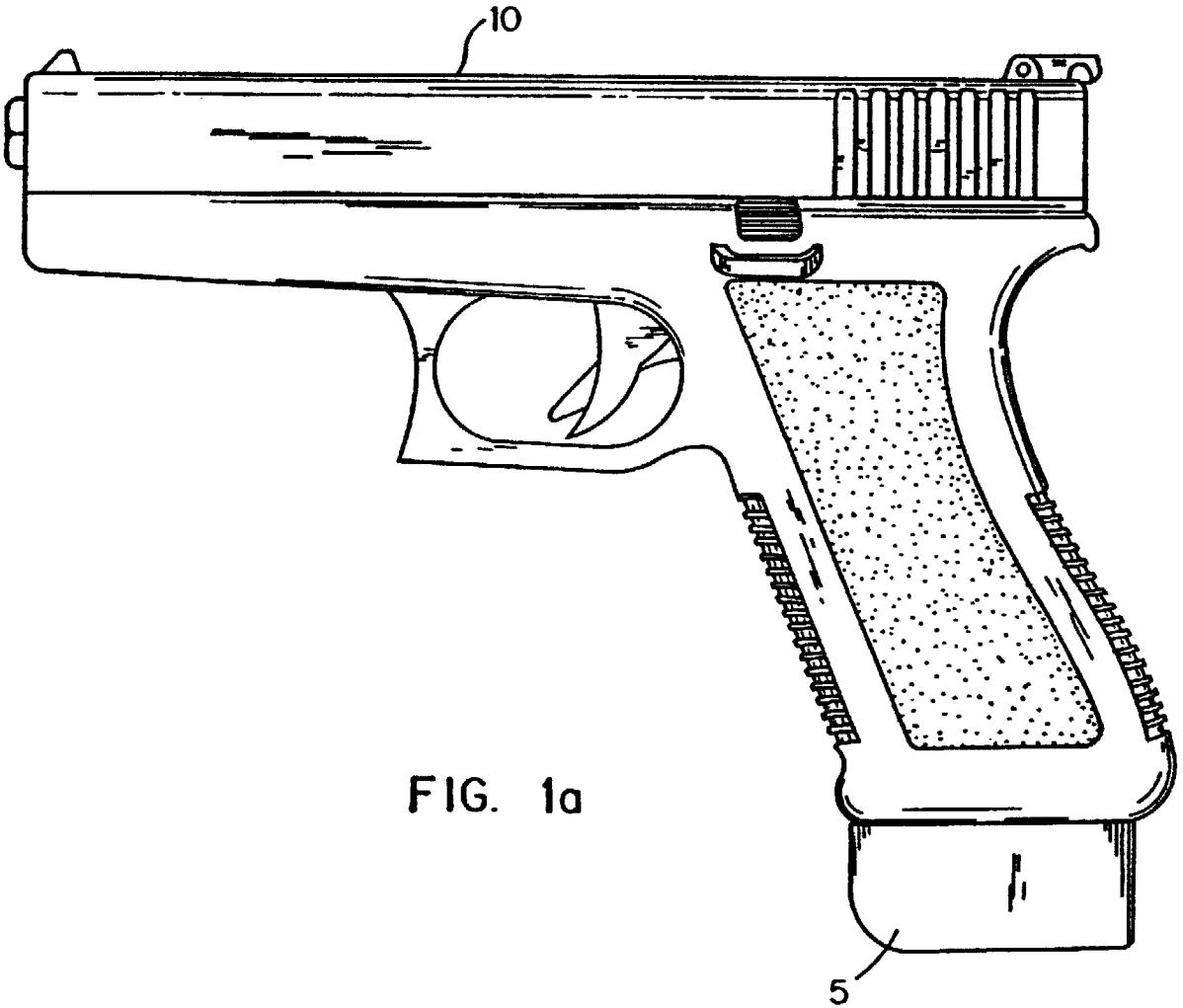
FIG. 1*a* is a side perspective view of a firearm incorporating the self-contained magazine according to the present invention.

FIG. 1*a* depicts a firearm 10 that is loaded with a magazine according to the present invention. Only housing extension 5 extending from housing 1 of the magazine is visible in FIG. 1*a*. Housing 1 is substantially completely fitted within the grip of firearm 10. FIG. 1*b* shows the magazine removed from the firearm 10, having a cut-away section to illustrate internal components of the magazine.

Figure 2:
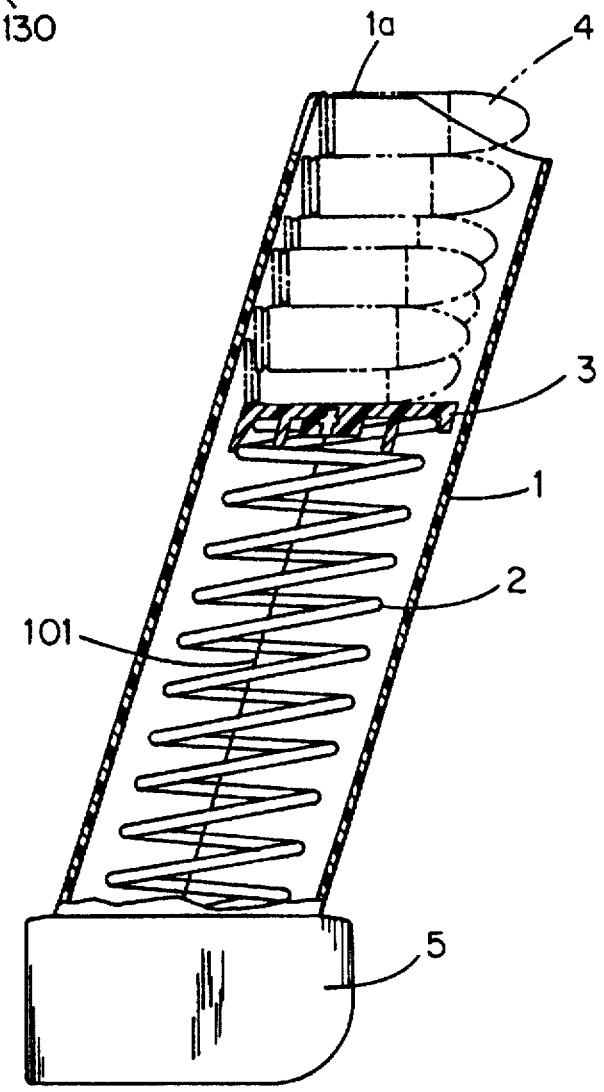
FIG. 2 is an elevated side view showing the general structure of the self-contained magazine according to the present invention.

As shown in FIG. 2, the basic components of the present magazine include housing 1 and housing extension 5 extending therefrom. Within housing 1 a spring 2 is provided to bias follower 3 in an upward direction so to bias rounds 4 through the upper opening provided in the housing 1. Housing 1 includes retention flanges 1*a*, against which the rounds are forced by the follower 3. This basic structure, save the housing extension 5, is generally known in the art.

Figure 3:
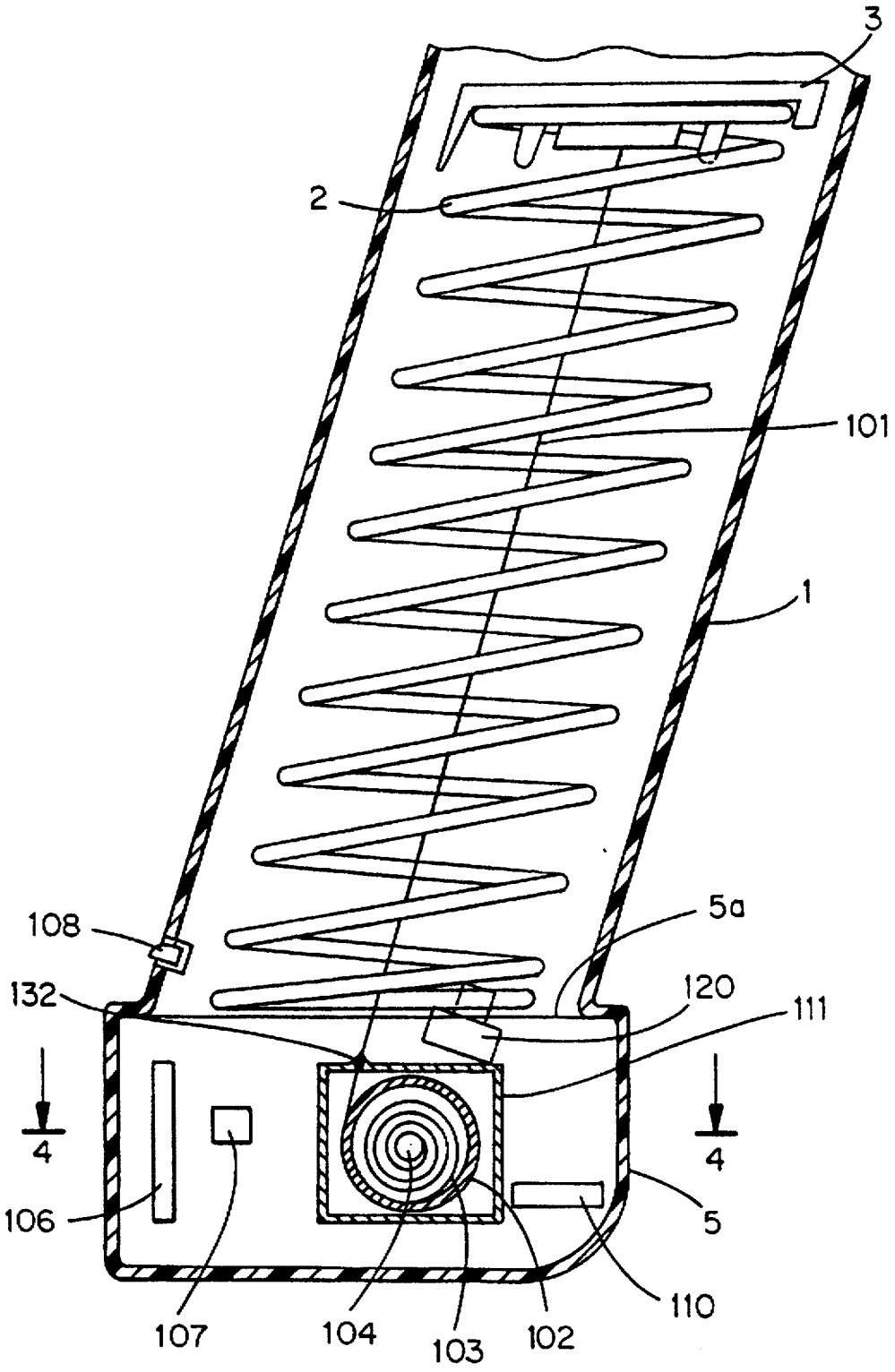
FIG. 3 is an exploded side view showing the interior components of a first preferable embodiment of the self-contained magazine according to the present invention.
Figure 4:
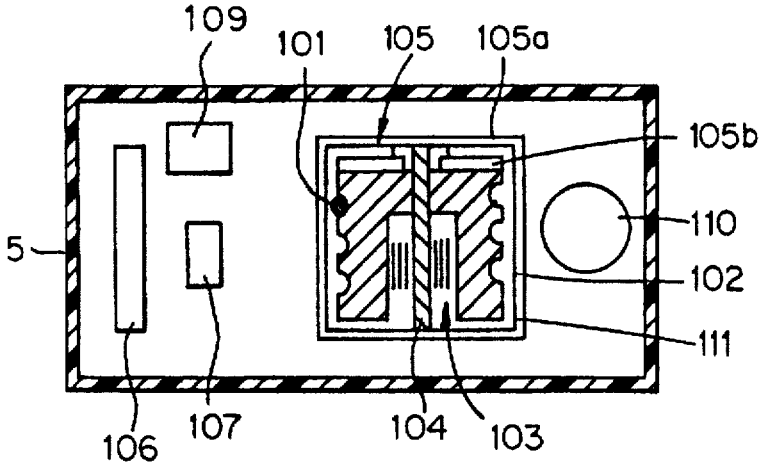
FIG. 4 is a cross-sectional view of FIG. 3 along line 4—4.

FIGS. 3 and 4 depict a first embodiment of the present invention that employs a cable take-up mechanism for determining the position of the follower 3 within the housing 1 of the magazine. The housing extension 5 includes an upper wall 5*a* against which the spring 2 presses, so as to bias the follower 3 upward.

The housing extension 5 contains mechanics and electronics that provide the counting functions according to the claimed invention. A cable 101 is attached to the follower and extends to drum 102 that rotates on shaft 104. A clock spring (i.e., constant force spring) 103 connects between the drum and shaft 104. The clock spring 103 is pretensioned to provide a retracting force to the cable 101 which is attached to and wrapped around the drum 102.

The cable 101 passes through a seal 132 where it enters inner housing 111. The seal can be made of commercially available sealant material. The seal 130 wipes the cable and prevents debris from entering an interior of inner housing 111, which would otherwise interfere with proper operation of the cable, drum and encoder mechanisms.

The angular position of the drum 102 is detected by a rotary encoder 105 that is fixed between the drum 102 and inner housing 111. The rotary encoder includes a fixed part 105*a* that is connected to the inner housing 111, and a rotating part 105*b* that is connected to the drum 102. The rotary encoder 105 may be particularly embodied as a potentiometer. A signal from the rotary encoder 105 that represents the angular position of the drum 102 is sent to computing circuit 109. The computing circuit 109 determines the number of rounds in the magazine and sends a signal to the display 106, for displaying the number of rounds. A back-light source 107 is provided for low-light viewing. A window is provided in the back face of the housing extension 5 through which the display 106 can be seen.

In high-capacity (30+) magazines in which a significant number of rounds are loaded, a gear reduction mechanism as known in the art may be provided between the drum 102 and rotary encoder 105 such that the rotary encoder 105 does not rotate beyond a single turn. Alternatively, the drum 102 may rotate multiple turns. In such a case, the power provided by battery 110 should be connected to the computing circuit 109 at all times, such that the computing circuit can maintain in memory the particular revolution of the drum 102, so that an accurate count is always sent to the display 106.

The battery 110 provides power for all electronics and lighting. The on-off switch 108 turns the electronic components on and off. The switch is closed when the magazine is installed in the gun, thereby providing power to the electronics.

Home switch 120 is activated when the magazine is full. Home switch 120 allows for automatic re-calibration of the electronic counter means according to the present invention. Each time the magazine is filled to capacity, the full point of the magazine is reset. When a round is removed, the switch 120 is released and the electronics apply the encoded position chart starting from the point at which the switch was released. This function compensates for cable stretch and other factors that can cause the sensor readings to drift off over time.

Figure 5:
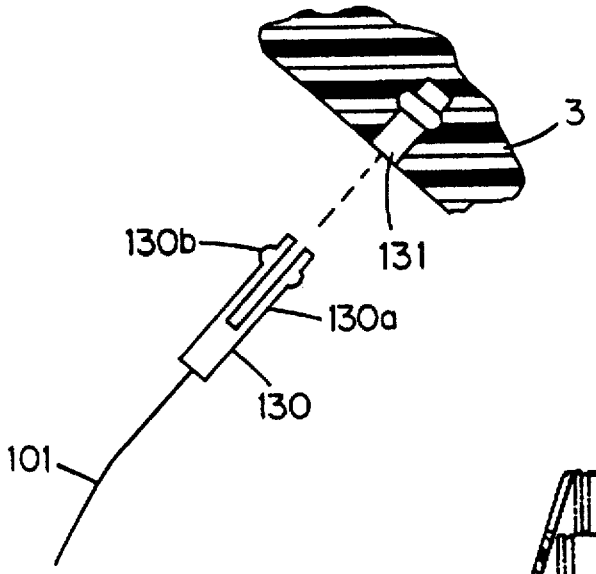
FIG. 5 is an exploded partial cross-sectional view showing a manner of connection between the follower and the cable of FIG. 3.

FIG. 5 illustrates a partial exploded view of the manner of connection between cable 101 and follower 3 shown in FIG. 3. Cable 101 is preferably connected to the follower 3 via breakaway clip 130 that is adapted to fit within orifice 131 of follower 3. The clip 130 has a split structure including fingers **130*a* that may be pressed together so as to slide into orifice 131. The fingers include a peripheral protrusion 130*b* that seats within a complementary recess in orifice 131. According to the breakaway clip 130 shown in FIG. 5, should the drum 103 become jammed thereby preventing unwinding of cable 101, the cable breaks away from the follower at the clip 130. Accordingly, the follower 3 may continue to move in an upward direction so as to dispense rounds and to insure firing. The break away structure shown in FIG. 5 further enhances safety by preserving movement of follower 3** and discharge of rounds from the firearm as needed by the user.

The number of rounds in the magazine is determined by measurement of the position of follower. For any magazine design, the position of the follower 3 in the magazine will be consistent for the same number of rounds in the magazine. A chart is developed recording the follower position against the number of rounds installed in the magazine. The chart is encoded in the computing circuit 109.

When operating, the position of the follower 3 is determined by accumulating its motion. Adding or removing rounds causes the follower 3 to change position. Adding rounds allows the cable 101 to retract, the drum 102 to rotate, and the cable 101 to wind-up around the drum 102. As rounds are removed, the cable 101 is pulled and the drum 102 rotates in the opposite direction. When the drum 102 turns, the output of the rotary encoder 105 changes, that is, in incremental positions the rotary encoder 105 outputs a signal that is used to calculate the particular position of the follower. This may be done by forming the rotary encoder 105 as a potentiometer, for example. Optical, capacitive and magnetic-type rotary encoders may also be utilized. Other devices may be utilized, such as contacting switches or non-contacting switches, the switches being in quadrature or multichannel codes, such as binary, Grey, and run length, among others.

For standard capacity magazines, the rotary encoder 105 will provide a one-to-one relationship between angular position of the drum 102 and the position of the follower 3. Accordingly, calculating the position of the follower will provide the number of rounds present in the magazine, via the computing circuit 109.

For high capacity (30+) magazines, the drum 102 will rotate more than one revolution for the full travel length of the follower 3 through the magazine. For such magazines, the revolution number as well as the position of the rotary encoder 105 and the drum 102 provide the position of the follower 3. In such a case, the battery 110 will be connected to the computing circuit 109 such that the revolution number is always maintained in memory by the computing circuit 109, even when the on-off switch 108 is on the "off" position.

The revolution number in high capcity (30+) magazines is maintained by monitoring the rotary encoder 105. The output of rotary encoder 105 is cyclical, and when the output of the rotary encoder 105 crosses a reference value in one direction, the revolution count is increased. When the output crosses the reference value in a reverse direction, the count is decreased.

The position of the follower 3 is converted to the number of rounds by the computing circuit 109. The position is compared to known values for a possible number of rounds. If the measurement is within a tolerance range of one of those values, the number of rounds is known and displayed. If the position value is not close to any one of those values, an error value may be reported insuring that an inaccurate count will not be displayed. Alternatively, the number of rounds may not change until a qualified new value is acquired.

While FIGS. 3 and 4 show a particular magazine, the magazine may be modified to fit any existing firearm. For example, curved magazines may be utilized for high capacity military rifles, for example.

Figure 6:
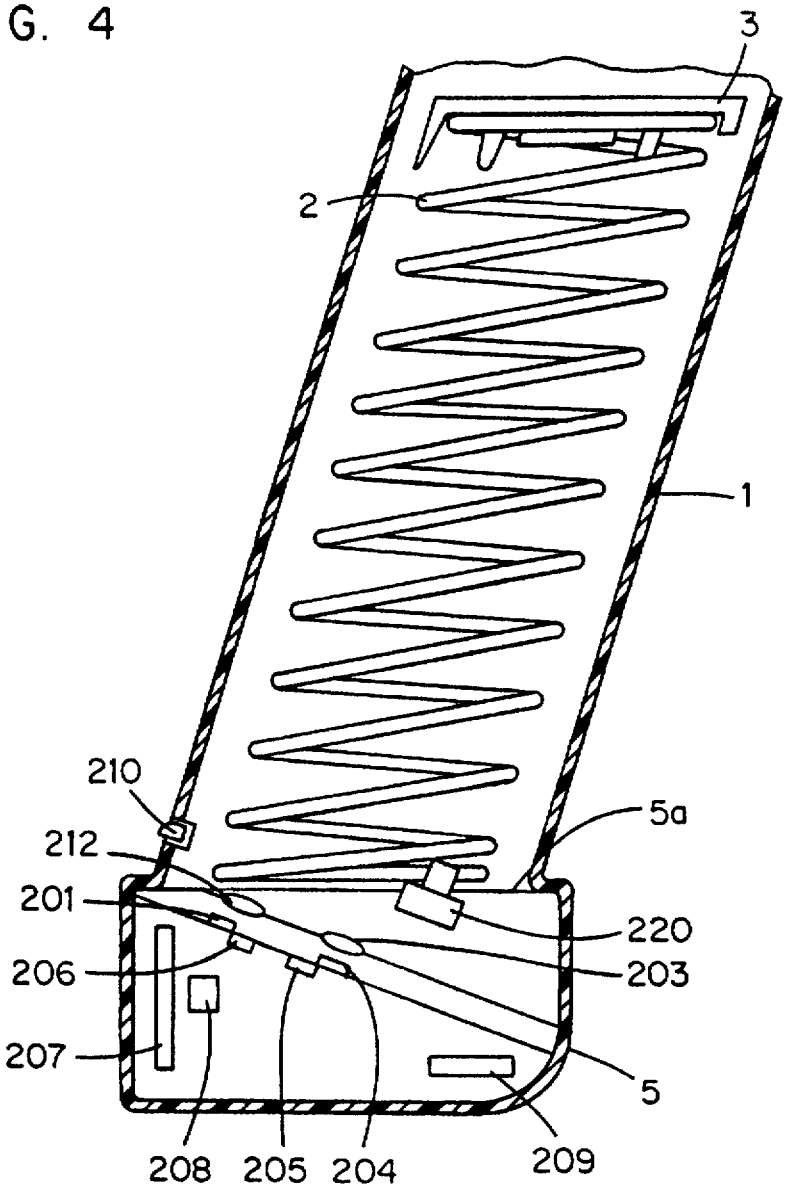
FIG. 6 is an exploded side view showing the interior components of another preferable embodiment of the self-contained magazine according to the present invention.
Figure 7:
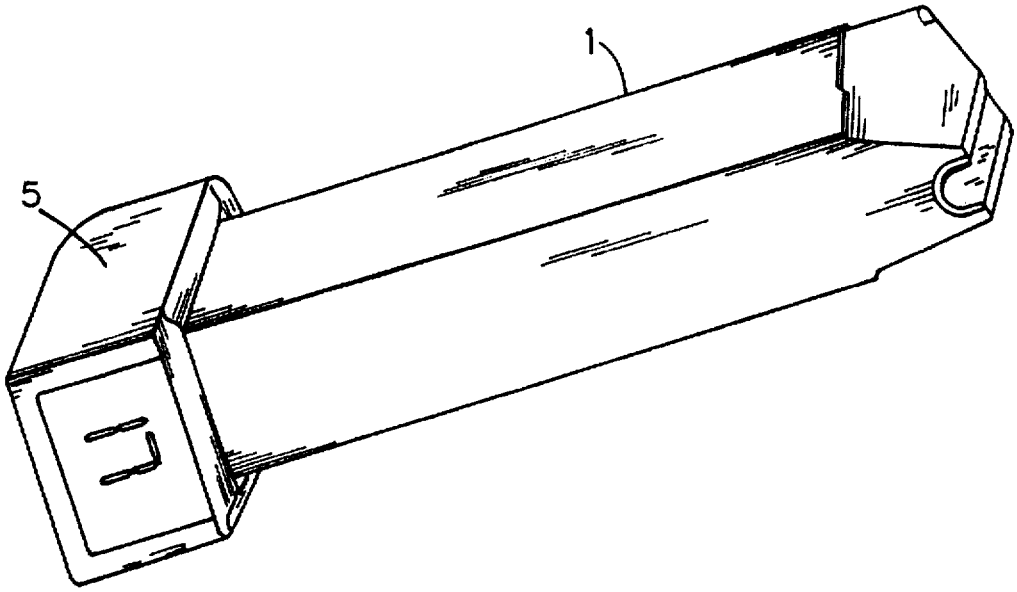
FIG. 7 is an elevated perspective view of an embodiment of the self-contained magazine according to the present invention.

FIG. 6 shows another preferable embodiment of the present invention, that employs an infra-red rangefinder for calculating position of the follower 3. FIG. 6 employs the type of rangefinding technology utilized in auto-focus cameras. As illustrated, an infra-red (IR) emitter 201 provides an IR light beam that is collimated by a collimating lens 212. The IR light is projected onto the follower 3 to form an object spot. The object spot is focused by focussing lens 203 into an image spot on position sensitive detector 204. The IR emitter 201 preferably generates laser light, although incoherent light may be utilized. In addition, an emitter that utilizes visible light may be used.

Two signals from the position sensitive detector 204 are processed by signal processor 205 and converted into a reading of the position of the spot on the position sensitive detector. The computing circuit receives a signal from the signal processor and converts that signal to the particular position of the spot and to the number of rounds present in the magazine. The value is displayed on the display 207, illuminated by back-light source 208 for low-light viewing.

The battery 209 provides power for all electronics and lighting. The on-off switch 210 provides power to the electronics and turns on the magazine.

The number of rounds in the magazine is determined by real-time measurement of the position of the follower 3. For each magazine design, the position of the follower 3 in the magazine will be consistent for the same number of rounds in the magazine. A chart is developed recording the position of the follower for each number of rounds installed in the magazine. The chart is subsequently encoded into the computing circuit.

When operating, the position of the follower is determined using triangulation. Triangulation, in this case, exploits the relationships of a right triangle. The IR emitter 201 and the position sensitive detector 204 form one side of the right triangle. The light projected from the IR emitter 201 forms the second side of the right triangle. The first two sides form a right angle. The third side (hypotenuse) of the right triangle is formed by the infra-red light reflected from the follower 3 to the position sensitive detector 204. The position sensitive detector 204 reports the angle between the line of reflected infra-red light and the first side of the triangle. Other angles could alternatively be reported as they could be converted to a usable angle using known relationships. Thus, knowing two angles and the length of one side of the triangle fully describes the triangle, and the length of the second side is determined, which represents the position of the follower. However, the angle formed by the first and second directions, the first angle, need not be a right angle. Accordingly, the computing circuit 206 can correlate this information to the number of rounds in the magazine.

Particularly, the position of the follower 3 is compared to known values by the computing circuit 206 for possible number of rounds. In accordance with the first embodiment discussed above, if the measurement is within a tolerance range of one of those values, the number of rounds is known and displayed. If the measurement is not close to any one of those values, an error value may be reported, insuring that an inaccurate count will not be displayed. Alternatively, the number of rounds may not change until a qualified new value is acquired.

The position sensitive detector 204 is used to determine the position where the IR light illuminates the follower 3. The illuminated spot on the follower 3 is called the object spot. The position sensitive detector 204 is a commercially available electronic component. Sharp Electronics has available a position sensitive detector that may be utilized, item number PD3101F.

The object spot on follower 3 is focused by the focussing lens 203 onto the position sensitive detector 204. The spot on the position sensitive detector 204 is the image spot. The position sensitive detector 204 consists of a strip of photodiode material. The position of the image spot on the position sensitive detector 204 is determined by the optical system. The focussing lens 203 and the angle from the axis of the focussing lens 203 to the object spot on the follower 3 determine where the image spot will be formed.

When illuminated, current is produced at the point of illumination on the position sensitive detector 204. The current is split and available at both ends of the strip. The relative magnitude of current at each end is determined by the particular position of the spot along the strip. Accordingly, the focussing lens is adapted to provide a fine spot or a fine line across the short axis of the strip of the position sensitive detector 204.

The signal processor 205 is attached to the position sensitive detector 204. The signal processor 205 measures the current coming from each end of the position sensitive detector 204 and determines the position of the spot. It reports position as a digital number. Such a signal processor is a commercially available electronic component, for example Sharp Electronics Corporation markets such a device under identification number IR3S85.

In all embodiments, a secondary battery providing a back-up power source may be employed to reduce possibility of losing power without warning. In such a case, a diagnostic circuit is incorporated in the magazine to determine low power in the primary battery, alert the user through the display, and switch to the secondary battery.

While the particular self-contained magazine and firearm combined therewith have been shown and described herein as preferred embodiments, it will be readily apparent that various changes and modifications could be made therein without departing from the spirit and scope of the invention as defined in the following claims.

What is claimed is:

1. A self-contained magazine for a firearm, comprising:

a housing for receiving a plurality of rounds therein, said housing including an open end through which rounds are loaded and unloaded;

a follower provided in said housing, said follower being slidable along a longitudinal axial direction of the magazine;

a spring biasing the follower toward said open end, to bias rounds toward said open end;

an electronic counter means integrated in the magazine for calculating the number of rounds contained in the magazine upon loading rounds into and unloading rounds from the magazine, said electronic counter means including a back-up power source; and display means for displaying the number of rounds in the magazine.

2. The magazine of claim 1, wherein said electronic counter means comprises a position sensor means for generating a signal as a function of a linear position of the follower, a computing circuit for receiving the signal from the position sensor means and correlating said signal to the number of rounds in the magazine, and a power source for supplying power to the position sensor means and computing circuit, the computing circuit being connected to the display means for displaying the number of rounds.

3. The magazine of claim 2, wherein the position sensor means comprises:

a cable connected to the follower, extending through a portion of the magazine and wrapping around a rotatable drum;

biasing means for applying a torsional force to said drum and a retracting force to said cable;

a rotary encoder connected to the drum for determining an angular position of the drum, the rotary encoder device being connected to the computing circuit.

4. The magazine of claim 3, wherein said rotary encoder comprises a component from the group consisting of a potentiometer, an optical rotary encoder, a capacitive rotary encoder, and a magnetic rotary encoder.

5. The magazine of claim 3, wherein said biasing means comprises a clock spring provided in said drum.

6. The magazine of claim 3, wherein an outer surface of the drum has a spiral-shaped groove for receiving the cable.

7. The magazine of claim 2, wherein the position sensor means comprises a rangefinder for determining the linear position of the follower.

8. The magazine of claim 7, wherein said rangefinder comprises:

an emitting means for projecting a light beam against the follower, said light beam forming an object spot on the follower;

a focussing lens for focussing the object spot to an image spot on a position sensitive detector; and a signal processor connected to the position sensitive detector for generating said signal, said signal representing the position of the image spot on the position sensitive detector.

9. The magazine of claim 8, wherein said emitting means comprises a light source and a collimating lens.

10. The magazine of claim 8, wherein the emitting means and the position sensitive detector are spaced apart from each other along a first direction, and the light beam projected from the light emitting means is projected along a second direction, the first direction being perpendicular to the second direction.

11. The magazine of claim 8, wherein the emitting means comprises a source for generating visible light.

12. The magazine of claim 8, wherein the emitting means comprises a source for generating infra-red light.

13. The magazine of claim 8, wherein the emitting means comprises a source for generating laser light.

14. The magazine of claim 1, wherein said display means comprises a component from the group consisting of an LCD display, an LED display, a vacuum fluorescent display, and an electroluminescent display.

15. The magazine of claim 14, wherein said display means further comprises a backlight source.

16. The magazine of claim 1, further comprising an on-off switch connected to the electronic counter means.

17. The magazine of claim 1, further comprising a home switch means for re-calibrating the electronic counter means, said home switch being activated by movement of the follower.

18. A weapon system, comprising:

a firearm for discharging rounds therefrom, said firearm including a magazine well; and an integrated, self-contained magazine adapted to be received in the well of the firearm for supplying rounds to the firearm, said magazine comprising:

a housing for receiving a plurality of rounds therein, said housing including an open end through which rounds are loaded and unloaded;

a follower provided in said housing, said follower being slidable along a longitudinal axial direction of the magazine;

a spring biasing the follower toward said open end, to bias rounds toward said open end;

an electronic counter means integrated in the magazine for calculating the number of rounds contained in the magazine upon loading rounds into and unloading rounds from the magazine, said electronic counter means including a back-up power source; and display means for displaying the number of rounds in the magazine.

* * * * *